United States Patent [19]

Ray

[11] Patent Number: 4,551,879

[45] Date of Patent: Nov. 12, 1985

[54] ENTRANCE DUST ARRESTER

[76] Inventor: Isaac Ray, 3700 Bedford Ave., Brooklyn, N.Y. 11229

[21] Appl. No.: 661,128

[22] Filed: Oct. 15, 1984

[51] Int. Cl.[4] ..... A47L 5/38

[52] U.S. Cl. ..... 15/301; 15/312 R; 15/314

[58] Field of Search ..... 15/300 R, 301, 312 R, 15/314

[56] References Cited

U.S. PATENT DOCUMENTS

| | | | |
|---|---|---|---|
| 2,599,049 | 6/1952 | Dollinger | 15/301 |
| 2,675,273 | 4/1954 | Sanders | 15/301 X |
| 2,895,159 | 7/1959 | Ostrow | 15/311 |
| 3,027,587 | 4/1962 | Bierstock | 15/301 |
| 3,027,588 | 4/1962 | Bierstock | 15/301 |
| 3,994,528 | 11/1976 | Humphrey | 15/301 X |

*Primary Examiner*—Chris K. Moore

*Attorney, Agent, or Firm*—Richard L. Miller

[57] ABSTRACT

An entrance dust arrester is provided which vacuums the area directly under a door as the door is opened and closed, thereby preventing the tracking of debris into a clean area. A housing with downward facing vacuum apertures may be attached to the outside of the door or may be built into the door itself. A system of air directing vanes distributes the vacuum evenly. The vacuum source itself may be integral to the housing or may be external and connected by a moveable coupling. The vacuum source is turned on and off by either or magnetic reed switch or a pressure operated switch.

9 Claims, 4 Drawing Figures

ENTRANCE DUST ARRESTER

BACKGROUND OF THE INVENTION

The instant invention relates generally to the field of maintenance and custodial equipment, and, more specifically to the field of equipment which arrests dirt, grit, and dust from floor surfaces.

In most buildings the majority of outside dirt and grit is brought in with upon the shoes of people entering the building. Instead of collecting this debris at the entrance to the building a great deal of money and energy is wasted by cleaning the dust from the entire inside floor area of the building. In some applications, great care must be taken to avoid contamination to critical manufacturing processes, and clean room areas may be designated.

Door mats are typically used to address this problem; however, the door mat soon becomes saturated with debris and additional traffic just transfers the remaining back and into the building. Individual footwear cleaners, typically consisting of rotating brushes into which a user's shoes are inserted, are impractical in situations where the traffic is particularly heavy or even moderate.

SUMMARY OF THE INVENTION

It is, therefore a primary object of the present invention to provide an entrance dust arrester which is either attached or integral to a door so that when the door is opened a vacuum is applied through apertures in the bottom of the door so that each time the door is opened, the flooring under the door is vacuumed.

Another object is to provide an entrance dust arrester in which the vacuum is equally distributed along the entire bottom surface of the door.

A yet further object is to provide an entrance dust arrester in which the vacuum source is integral to the housing which contains the vacuum apertures.

A still further object is to provide an entrance dust arrester in which the vacuum source is separate from the housing which contains the vacuum apertures wherein the vacuum source is connected to the housing by a radially movable joint.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENTS

Figure 1:
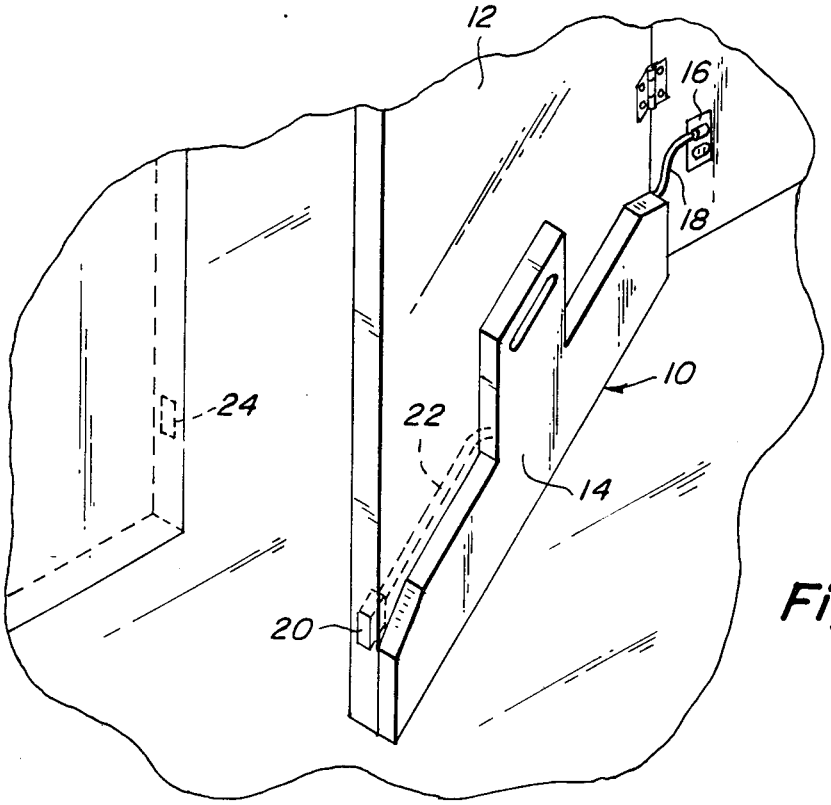
FIG. 1 is a perspective view of the invention mounted on a partly opened door.

FIG. 1 best illustrates an embodiment of the invention in which the invention 10 is mounted upon door 12. A vacuum source contained inside housing 14 is powered by power outlet 16 via power cord 18. Power to the vacuum source contained inside housing 14 is controlled by reed switch 20 via control cable 22. When door 12 is closed, magnet 24 prevents reed switch 20 from activating the vacuum source. When door 12 is opened, reed switch 20 activates the vacuum source whereby air and dirt are sucked into housing 14 through apertures in the bottom of housing 14. As door 12 is opened, an arc of flooring material, such as carpeting, under the bottom of door 12 is vacuumed clean.

Figure 2:
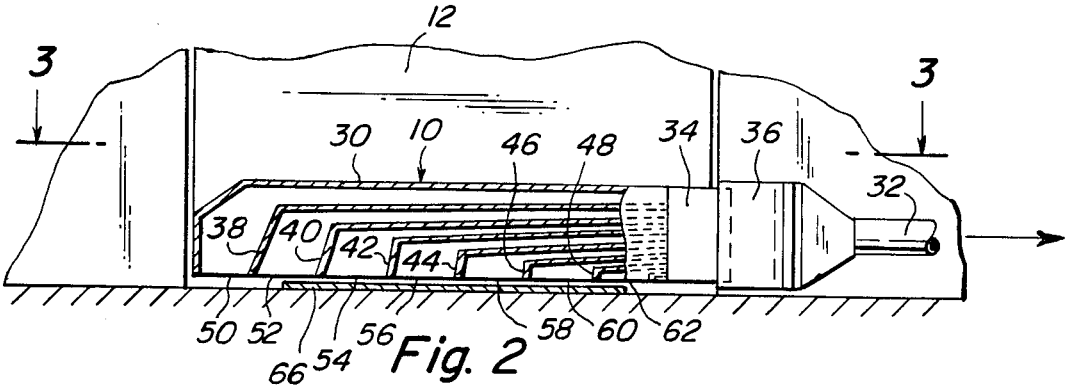
FIG. 2 is a front elevational view partly in section of a first modification thereof.
Figure 3:
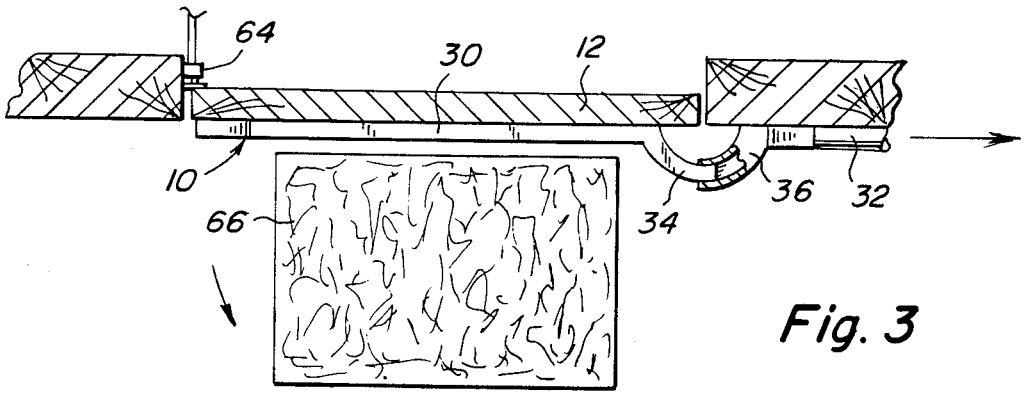
FIG. 3 is a cross sectional view taken along line 3—3 in FIG. 2 with parts broken away.

FIGS. 2 and 3 best illustrate an embodiment of the invention in which the vacuum source is external to the housing 30. The external vacuum source is connected to the housing 30 via air inlet hose 32 and a radially moveable connector made from a radial male section 34 which slides radially inside radial female section 36. This connector, although moveable, creates an airtight seal. The inrushing vacuum from the vacuum source is distributed evenly along the bottom surface of the door by a system of air deflection vanes 38,40,42,44,46, and 48 define the boundaries of apertures 50,52,54,56,58,60, and 62 respectively. This system of air deflection vanes may be applied to any of the embodiments of the invention. The vacuum source is operated by pressure operated switch 64 and mat 66 is vacuumed in a manner precisely as already described.

Figure 4:
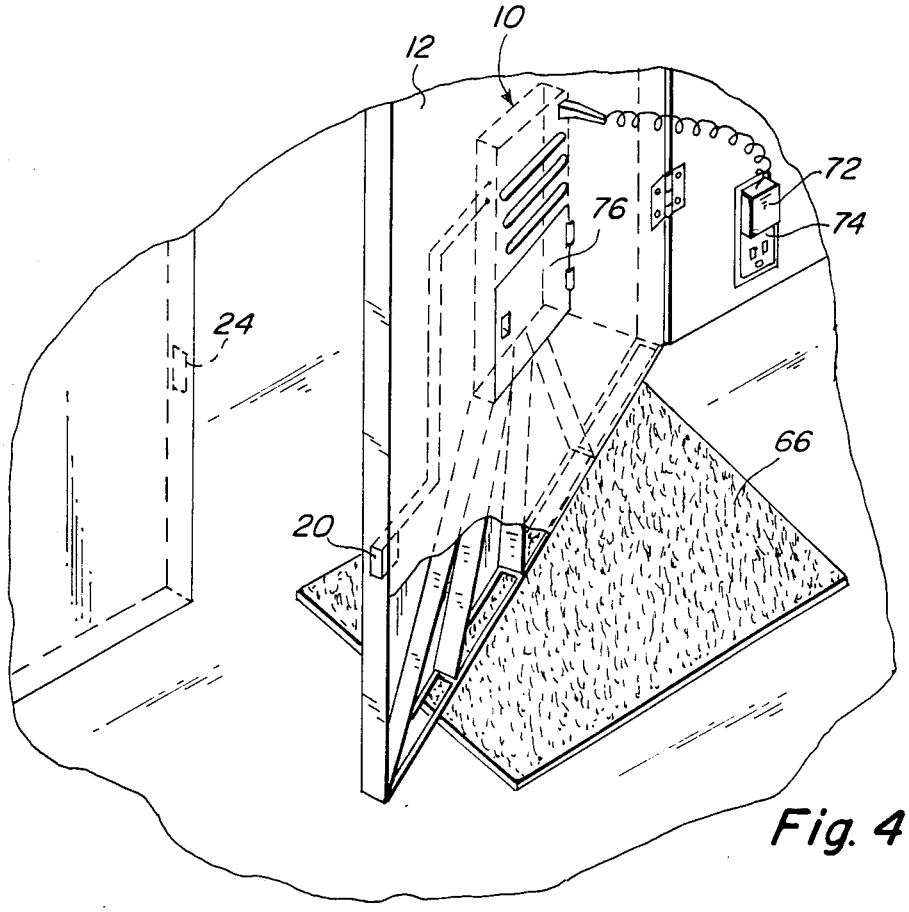
FIG. 4 is a perspective view of a second modification of the invention mounted within a partly opened door.

In FIG. 4, the invention 10, is formed within the door and together with internal vacuum source is equipped with a rechargeable battery which is recharged by recharger 72 which is plugged into power outlet 74. A filter bag change door 76 allows the facile changing of dust collection bags. In all other respects this embodiment operates in a manner precisely as already described.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An entrance dust arrester, comprising in combination:

(a) a pneumatic vacuum source; and, (b) a housing communicating with said vacuum source which directs the application of said vacuum in a downward direction such that said vacuum is applied along a downward facing planar surface via at least one aperture, said housing being attached to an entrance door to move therewith, such that said housing sweeps an arc over a flooring surface to which said downward facing planar surface is in close proximity when said door is rotated upon its hinges, thereby vacuuming said arc of said flooring.

2. An entrance dust arrester, as recited in claim 1, wherein said pneumatic vacuum source is located within said housing and said flooring is covered with carpeting.

3. An entrance dust arrester, as recited in claim 1, wherein said pneumatic vacuum source is external to said housing and is attached to said housing by a connecting means.

4. An entrance dust arrester, as recited in claim 3, wherein said connecting means comprises a arcuately shaped male tube which slides inside a arcuately shaped female tube such that said male tube moves in arc inside said female tube while retaining an air-tight seal.

5. An entrance dust arrester, as recited in claim 1, wherein said housing is mounted to the outside surface of said door.

6. An entrance dust arrester, as recited in claim 1, wherein said housing is mounted inside said door.

7. An entrance dust arrester as recited in claim 1, further comprising one or more air deflection vanes positioned inside said housing such that the flow of air to said vacuum source is equally distributed along said downward facing planar surface.

8. An entrance dust arrester, as recited in claim 1, further comprising a switch which turns said vacuum source on when said door is opened and turns said vacuum source off when said door is closed.

9. An entrance dust arrester, ås recited in claim 8, wherein said switch is a magnetically operated reed switch.

* * * * *